US006655942B1

(12) United States Patent
Rivola

(10) Patent No.: US 6,655,942 B1
(45) Date of Patent: Dec. 2, 2003

(54) PRESSURE CASTING APPARATUS UTILIZING WITH TWO-PART MOULDS

(75) Inventor: Pietro Rivola, Imola (IT)

(73) Assignee: Sacmi-Cooperativa Meccanici Imola -Soc. Coop. A.R.L., Imola (IT)

( * ) Notice: Subject to any disclaimer, the term of this patent is extended or adjusted under 35 U.S.C. 154(b) by 0 days.

(21) Appl. No.: 09/545,408

(22) Filed: Apr. 7, 2000

(30) Foreign Application Priority Data

Apr. 9, 1999 (IT) ..... RE99A0042

(51) Int. Cl.[7] ..... B28B 1/26; B28B 7/00

(52) U.S. Cl. ..... 425/84; 425/85; 425/234; 425/339; 425/405.1; 100/195

(58) Field of Search ..... 425/84, 85, 338, 425/339, 233, 234, 405.1; 264/86; 100/258 A, 258 R, 193–195

(56) References Cited

U.S. PATENT DOCUMENTS 4,798,525 A * 1/1989 Sato et al. ..... 425/84
5,741,388 A * 4/1998 Gerster et al. ..... 425/85

FOREIGN PATENT DOCUMENTS

EP 0 332 896 A 9/1989
EP 561613 A1 * 9/1993
EP 999021 A2 * 5/2000
GB 1359684 * 7/1974
GB 2 330 109 A 4/1999
JP 08 099 307 A 4/1996

* cited by examiner

*Primary Examiner*—Robert Davis
*Assistant Examiner*—Thu Khanh T. Nguyen
(74) *Attorney, Agent, or Firm*—Birch, Stewart, Kolasch & Birch, LLP

(57) ABSTRACT

A apparatus for pressure casting sanitary appliances including an outer framework, at least one block slidable within the outer framework arid having a male mould part and a female mould part, a fixed endpiece for said framework being provided with the male part which is adapted to be inserted into the female part of said at least one block, a movable head of the framework being provided with the female mould part which is adapted to receive the male part of said at least one block, means for thrusting said movable head in the direction of said fixed endpiece, and means for feeding pressurized slip into the cavities which form when said locks are positioned one against the other, wherein at least the mould portion defining the cavity of the female mould part is surrounded by at least one inflatable element provided with a pressurized fluid.

13 Claims, 2 Drawing Sheets

PRESSURE CASTING APPARATUS UTILIZING WITH TWO-PART MOULDS

BACKGROUND OF THE INVENTION

The present invention relates to pressure casting lines for sanitary appliances, in particular lines for forming sanitary appliances with moulds comprising of only two parts.

Sanitary appliances are formed by casting slip in hygroscopic and/or permeable moulds, which can includes two or more arts depending on the complexity of the appliance to be formed.

Plaster moulds have been traditionally used, the absorbent power of the plaster being utilized to dehydrate the ceramic slip. However the use of this type of mould involves very lengthy forming cycles. Moreover plaster moulds last for only a small number of forming cycles.

For these reasons manufacturers have devised porous resin moulds possessing much better mechanical characteristics than plaster moulds, with the result that pressure casting techniques can be used, in which the slip is fed generally at a pressure of between 3 and 15 bar.

To counteract the forces generated by the pressurized slip in a direction perpendicular to the contact surfaces between the various mould parts, resin moulds have to be clamped by special sophisticated closure devices of high cost. For this purpose, machines are known which exert a mould clamping force, in the mould closure direction, which is sufficient to counteract the force exerted by the internal mould pressure at any time.

These moulds are stressed not only in their closure direction but also in directions perpendicular to the closure direction, hence they have to include lateral reinforcement structures the purpose of which is to limit their outward deformation. Such structures generally comprise adjustable means enabling the mould sides to be precompressed. This enables mould deformation to be reduced with a consequent increase in its strength, both because resins withstand compression better than tension, and because the deformation imposed on the mould, being opposite to that caused by the slip pressure, at least partly nullifies the effects, thereby limiting the tensions within the mould during casting.

Notwithstanding said adjustable means in the form of lateral reinforcements, the maximum usable casing pressure remains limited, in the known art, by the deformation which the mould undergoes as a result of the stresses to which it is subjected.

The deformation induced by the casting pressure also depends on the shape of the piece to be formed. In this respect, for certain types of appliances the mould is subjected, in certain parts, to very high stresses which, on the one hand can cause premature mould fracture and, on the other hand can produce considerable tensions within the appliance being formed. These tensions result in fracture of the appliance either during its removal from the mould or during one of the subsequent processing stages, i.e., drying and firing. Consequently, in forming the aforesaid types of appliances, the casting pressure used must not be too high, which increases the forming time.

To increase the casting pressure, manufacturers have provided increasingly rigid lateral containment structures, in order to limit the outward deformation of the mould. However, even if a theoretically (infinitely) rigid lateral containment structure were possible, it would not completely solve the problem because of tile compressibility of the resin with which the moulds are made. In this respect, even if outward deformation of the mould were completely prevented, the forming cavity would expert because of the casting pressure, thereby elastically contracting the resin forming the mould walls.

Elastic contraction of the mould walls results in substantial problems on removing the appliance from the mould, in that when the casting pressure ceases, the walls return to their original volume to consequently clamp the appliance within the forming cavity.

SUMMARY OF THE INVENTION

An object of the present invention is to overcome the aforesaid drawbacks within the frames cork of a rational, reliable arid relatively low-cost solution.

This and further objects are attained by providing an apparatus for pressure casting sanitary appliances by moulds comprising only two parts, namely a male part and a female part penetrated by this latter.

In the casting apparatus of the present invention, the moulds are positioned in series, and formed into blocks composed of the female part of one mould and that male part which is to be inserted into the female part of the adjacent block. When the male part of one block is inserted into the female part of the next block, the mould closure forces are compensated between one mould and the next along the forming line which has therefore to counteract only the closure force of a single mould, whatever the number of its constituent moulds. The line construction is therefore light and economical, practically without limitation on the number of moulds present therein.

Those forces directed perpendicular to the mould closure direction are compensated for, according to the present invention, by are external frame comprising means for exerting from the outside a pressure on the mould which is closed, substantially equivalent to that which the slip exerts from the inside, so as to prevent, at any moment, any deformation thereof.

The pressure exerted from the outside can be conveniently controlled to be above or below the casting pressure, to allow small deformations of a desired amount, to facilitate forming the piece and removing it from the mould.

The means for exerting a pressure on the outer lateral surface of the mould can be an element, which surrounds at least that lateral surface of the block corresponding to the forming cavity, and this element can be inflated by a suitable fluid.

BRIEF DESCRIPTION OF THE DRAWINGS

The present invention will be more apparent from the ensuing description of a preferred embodiment thereof as described with the aid of the accompanying drawings, wherein.

DETAILED DESCRIPTION OF THE INVENTION

Figure 1:
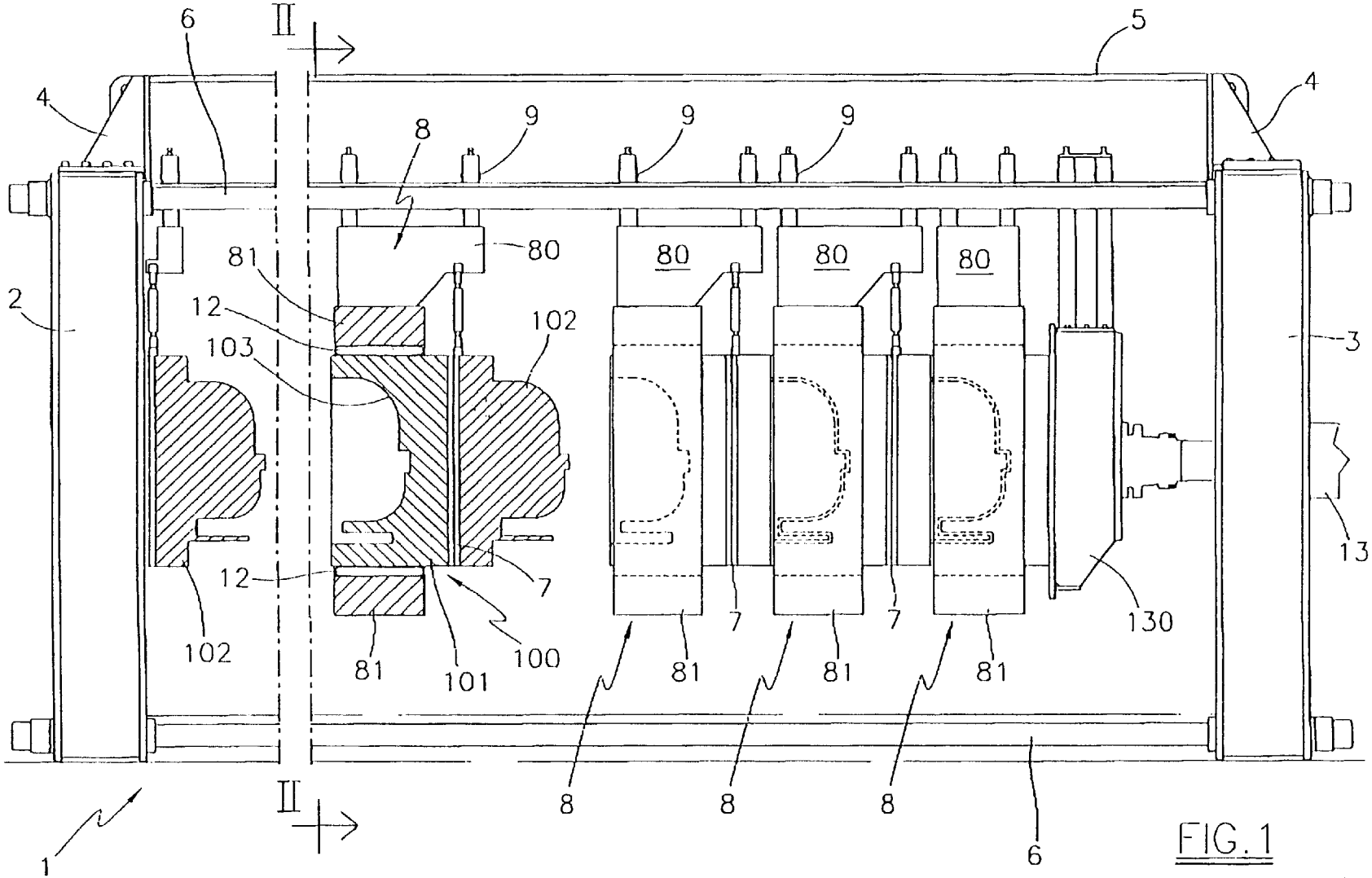
FIG. 1 is a partial, sectional side view of the present invention.
Figure 2:
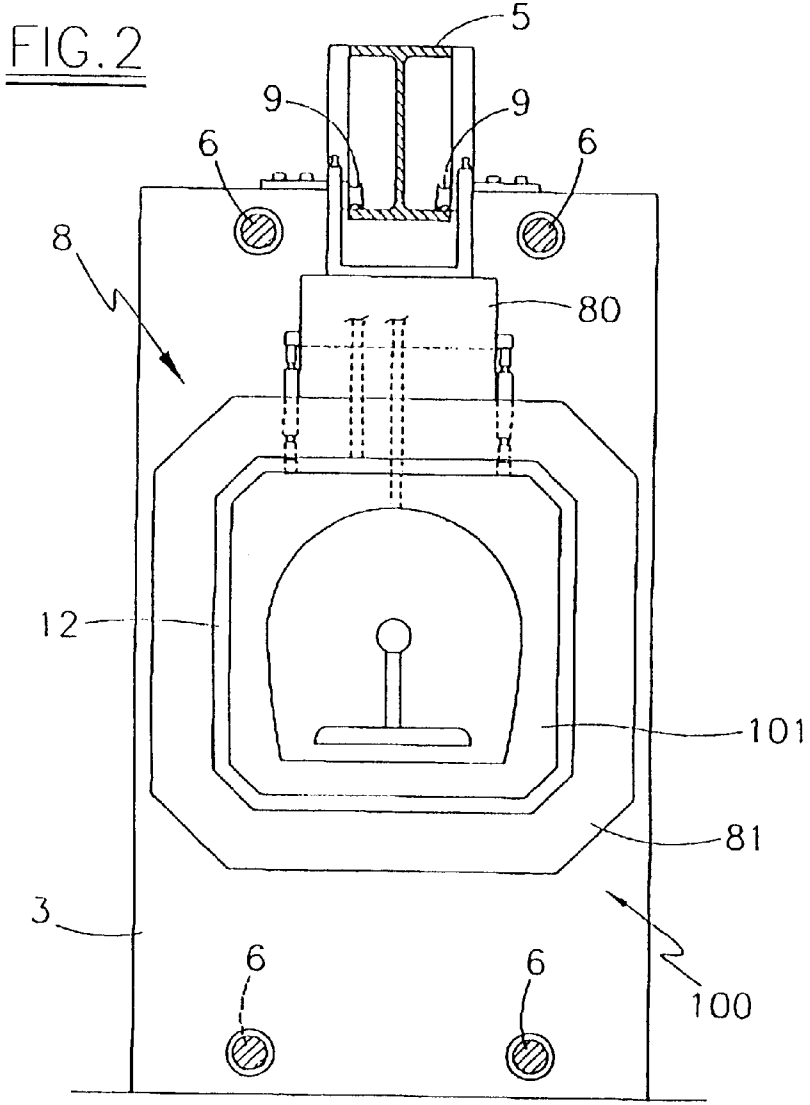
FIG. 2 is a section taken along the plane II—II of FIG. 1.

FIGS. 1 and 2 show the apparatus 1, comprising two endpieces 2 and 3, each of which comprises in en upper central position a flange 4 for fixing is to a beam 5 of I cross-section.

The two endpieces 2 and 3 are connected together by four identical parallel bars a positioned at the vertices of the quadrilateral endpieces as shown in FIG. 2.

The beam 5 is arranged to support the blocks 100, each composed of a female part 101 of one mould, on the rear of which is fixed the usual flanges 7 the male part 102 of the adjacent mould.

In the detail, each block 100 is supported by the beam 5 via a carriage 8, which is susupended from the beam 5 by wheels 9 which enable it to traverse in the direction of the longitudinal axis of the beam 5.

Each carriage 8 comprises an upper plate 80 to which the wheels 9 are fixed, and which supports a rectangular frame 81 therebelow.

The purpose of the frame 81 is to contain the female part 101 of the block 100, an inflatable element 12 being interposed between the outer wall of the female part 101 and the inner wall of the frame 81. The inflatable element 12 is provided with a, liquid or gaseous fluid from a usual system, not shown, which maintains the fluid pressure in the element 12 equal, at any moment, to the pressure exerted by the slip inside the cavity which forms when two blocks 100 are brought into contact to copenetrate.

The endpiece 2 carries a male mould part 102 aligned with the suspended blocks 100, whereas the endpiece 3 supports a cylinder-piston unit 13 connected to a slidable thrust head 130 carrying a female mould part 101, and arranged to maintain the blocks 100 in contact with each other and with said male part 102.

Figure 3:
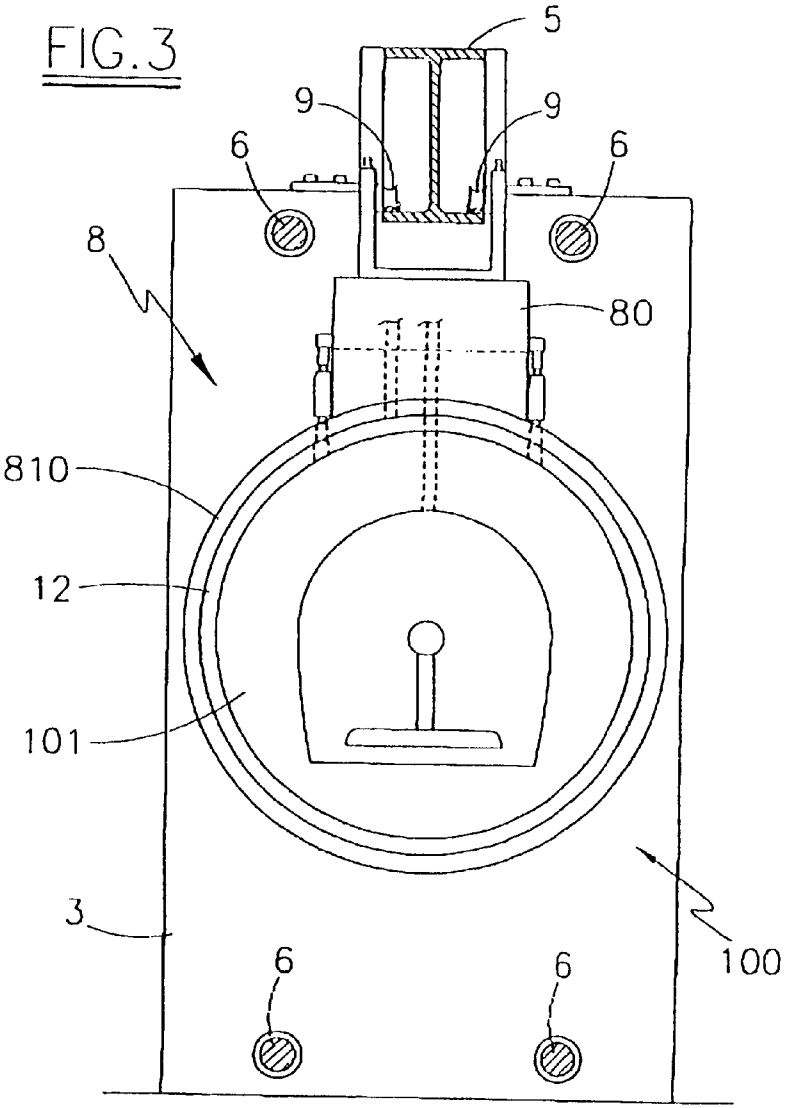
FIG. 3 is a section through a variant of the present invention, taken on a plane parallel to the plane II—II.

FIG. 3 shows a variant of the present invention which differs from FIG. 2 with regard to the shape of the frame, indicate in FIG. 3 by the reference number 810, surrounding the female part 101 of the block 100.

In this case the frame 810 is vircular instead 0f rectangular. This enables the frame to be constructed with every small thickness, preferably of between 4 and 50 mm, as the frame has to support only tensile stresses and not bending stresses.

The invention operates as follows.

With reference to FIG. 1, the operator moves the first carriage 8 on the left against the male part 102 fixed to the endpiece 2, so that this becomes inserted into the female part 101 of the block. The operator proceeds in the same manner with all the remaining blocks, and finally operates the cylinder-piston unit 13 to urge the movable head 130 to axially lock all the blocks 100 against each other and against the endpiece 2.

Having thus closed the moulds, pressurize slip is injected into the various moulds and elements 12 are inflated to pressure equal to the pressure of the slip inside the moulds.

In this manner, the forces due to the casting pressure in directions parallel to the mould closure plane are nullified.

It should be noted that for some appliances, the pressure introduced into the interior of the inflatable element could be different from the instantaneous pressure of the slip in order to introduce into the mould controlled deformations which, disappearing when the pressure ceases, facilitate the removal of the appliance from the mould.

On termination of the forming operation, all the aforelisted operations are effected in the reverse order, to enable the pieces to be removed from the moulds.

From the description it is apparent that the frames 81 and 810 are dimensioned not for rigidity but to withstand the pressure exerted by the inflatable elements 12. This means that frames can be constructed which are much lighter for equal efficiency.

The present invention can also be usefully applied if a single sanitary appliance is to be formed, one at a time.

In this case the blocks 100 are dispensed with, and the thrust head 130 carries fixed to it the mould part 101 which, on receiving the mould part 102 rigid with the endpiece 2, creates the single forming cavity.

In this latter case it could be convenient to arrange the apparatus in a vertical position with the movable head 130 positioned at the top, the remainder remaining unchanged.

Finally, instead of a single frame 81 or 810, several frames could be used side by side.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for pressure casting sanitary appliances, which comprises an outer framework, at least one block slidable within said outer framework and including a male mould part and a female mould part, a fixed endpiece of said framework being provided with the male part which is to be inserted into the female part of said one block, a movable head of said framework being provided with the female mould part which is adapted to receive the male part of said one block, means for thrusting the movable head in the direction of the fixed endpiece, and means for introducing pressurized slip into cavities which are formed when said blocks are positioned one against the other, wherein a mould portion which defines a tile cavity of the female mould part is surrounded by at least one frame, said mould portion and said frame defining a space therebetween which is provided with at least one inflatable element containing a pressurized fluid for exerting pressure on the outer lateral surface of the female portion of the mould.

2. The apparatus as claimed in claim 1, wherein no blocks are provided, and the male part of the fixed endpiece is inserted into the female part of the movable head.

3. The apparatus as claimed in claim 1, wherein the pressure inside the inflatable element is adjustable.

4. The apparatus as claimed in claim 1, wherein the pressure inside the inflatable element is maintained, at any moment, equal to the slip pressure.

5. The apparatus as claimed in claim 1, wherein the pressure inside the inflatable element is maintained, at any moment, at a pressure which is predetermined on the basis of the slip pressure.

6. The casting apparatus as claimed in claim 1, wherein the means for thrusting rise movable head is a cylinder-piston unit arranged to exert a thrust at least equal to that exerted by the slip introduced into the mould.

7. The apparatus as claimed in claim 1, wherein the frame is of a polygonal, sectional configuration.

8. The apparatus as claimed in claim 1, wherein the frame has a cylindrical configuration.

9. The apparatus as claimed in claim 1, wherein, when assembled, the mould has a cylindrical outer shape.

10. An apparatus for pressure casting sanitary appliances, which comprises an outer framework, at least one block slidable within said outer framework and including a male mould part and a female mould part, a fixed endpiece of said framework being provided with the male part which is to be inserted into the female part of said one block, a movable head of said framework being provided with the female mould part which is adapted to receive the male part of said one block, means for thrusting the movable head in the direction of the fixed endpiece, and means for introducing pressurized slip into cavities which are formed when said blocks are positioned one against the other, wherein a mould portion which defines a tile cavity of the female mould part is surrounded by a frame which is open on at least two sides, said mould portions and said frame defining a space therebetween which is provided with an inflatable element containing a pressurized fluid.

11. The apparatus of claim 10, wherein the inflatable element acts in a direction substantially orthogonal to the translating and opening direction of the mould parts.

12. An apparatus for pressure casting sanitary appliances, which comprises:

an outer framework;

at least one block slidable in a first direction within said outer framework and including a male mould part and a female mould part;

a fixed endpiece of said framework being provided with the male part which is to be inserted in the first direction into the female part of said one block;

a movable head of said framework being provided with the female mould part which is adapted to receive in the first direction the male part of said one block, said female mould part having at least one wall which is deformable in second direction;

means for thrusting the movable head in the direction towards the fixed endpiece in the first direction, and means for introducing pressurized slip into cavities which are formed when said blocks are positioned one against the other;

at least one frame for surrounding the mould portion which defines the tile cavity of the female mould, defining a space between the at least one frame and the mould portion;

at least one inflatable element containing a pressurized fluid positioned in the space between the at least one frame and the mould portion, said at least one inflatable element acting on the at least one wall of the female mould part in the second direction; and wherein the first direction and the second direction are substantially orthogonal relative to each other.

13. The apparatus of claim 12, wherein the female mould part has two walls which are deformable in a direction substantially orthogonal to the first direction.

* * * * *